US009598227B2

(12) United States Patent
Franz et al.

(10) Patent No.: US 9,598,227 B2
(45) Date of Patent: Mar. 21, 2017

(54) VALVE FOR AEROSOL CONTAINER

(71) Applicants: Walter Franz, Gemuenda (DE); Kerstin Seling, Doerfles-Esbach (DE)

(72) Inventors: Walter Franz, Gemuenda (DE); Kerstin Seling, Doerfles-Esbach (DE)

(73) Assignee: THOMAS GMBH, Langenselbold (DE)

( * ) Notice: Subject to any disclaimer, the term of this patent is extended or adjusted under 35 U.S.C. 154(b) by 102 days.

(21) Appl. No.: 14/591,030

(22) Filed: Jan. 7, 2015

(65) Prior Publication Data

US 2015/0197392 A1 Jul. 16, 2015

(30) Foreign Application Priority Data

Jan. 13, 2014 (DE) ..... 10 2014 100 280

(51) Int. Cl.
*B65B 1/04* (2006.01)
*B65D 83/48* (2006.01)
*B65D 83/42* (2006.01)

(52) U.S. Cl.
CPC ..... *B65D 83/48* (2013.01); *B65D 83/425* (2013.01)

(58) Field of Classification Search
CPC ..... B65B 3/003; B65D 83/42; B65D 83/425; B65D 83/48
USPC ..... 141/20
See application file for complete search history.

(56) References Cited

U.S. PATENT DOCUMENTS 2,890,817 A * 6/1959 Rheinstrom ..... B65D 83/425 141/15
4,078,705 A * 3/1978 Butcher ..... B65D 83/425 222/402.24

FOREIGN PATENT DOCUMENTS

DE 3807156 A 9/1989

* cited by examiner

*Primary Examiner* — Jason K Niesz
(74) *Attorney, Agent, or Firm* — Andrew Wilford

(57) ABSTRACT

A valve for an aerosol container has a valve plate adapted to close an axial end of the container, a valve subassembly having at least one dispensing element, a seal ring, and a compression spring, and a valve holder containing the valve subassembly and having an axially open assembly hole through which the valve subassembly can pass. A cover closes the assembly hole and is formed with an axially throughgoing cover hole through which the dispensing element projects and with which the dispensing element forms an annular and axially extending passage. A seal ring surrounds the dispensing element and is engaged between the holder and the cover. A spring biases the dispensing element axially outward against the seal ring and presses an axial outer face of the seal ring against the axially inner face of the cover. Passages extend axially between an interior of the container and the seal ring.

18 Claims, 14 Drawing Sheets

VALVE FOR AEROSOL CONTAINER

FIELD OF THE INVENTION

The present invention relates to a valve for an aerosol container. More particularly this invention concerns such a valve serving both for filling the container and dispensing the contents of the container.

BACKGROUND OF THE INVENTION

A typical aerosol-container valve has a valve plate, a valve subassembly that has at least one dispensing element, one seal ring, and one compression spring, and a holder for the valve subassembly. The valve holder has on its upper or axial outer side an assembly opening for inserting the valve subassembly. The assembly opening of the valve holder connected to the valve plate is closed by a surface that has a throughgoing passage for the dispensing element. The seal ring is clamped between this surface and an annular seat face surrounding the assembly opening of the valve holder, and closes a port of the dispensing element when the dispensing element, under the effect of the compression spring, is axially biased against the seal ring. The dispensing element is a stem or actuator. On its bottom side, the valve holder has a connection for an intake tube or other specific components that produce a fluid connection to the interior of the aerosol container.

A valve with the described features is known from DE 38 07 156. The valve plate of the known valve is made of plastic and has a one-piece molded valve holder in which the valve is inserted. The valve holder is then closed by a plastic cover that is tightly connected to the valve plate by welding. The seal ring engages in an outwardly open annular groove of a stem when the stem, under the effect of the compression spring, is axially biased against the seal ring. Above the ring groove, the diameter of the stem is larger than the diameter of a more distant section. To pressure-fill an aerosol container closed by the valve, the stem is pushed down into the interior of the valve holder until a small-diameter section of the stem moves into the throughgoing hole of the plastic cover and thereby forms an annular throughgoing passage for the propellant. The fluid flows through a gap between the seal and the stem in the valve holder, flows through the valve holder and from there goes into the interior of the aerosol container. Since the stem has a smaller diameter for design reasons and is guided inside the valve holder by a sliding seat, the flow path suffers from a noticeable pressure loss that has a detrimental effect on the filling speed.

OBJECTS OF THE INVENTION

It is therefore an object of the present invention to provide an improved valve for aerosol container.

Another object is the provision of such an improved valve for aerosol container that overcomes the above-given disadvantages, in particular that allows for a larger flow cross-section during pressure-filling and is sealed tight again after pressure-filling.

SUMMARY OF THE INVENTION

A valve for an aerosol container has according to the invention a valve plate adapted to close an axial end of the container, a valve subassembly having at least one dispensing element, a seal ring, and a compression spring, and a valve holder containing the valve subassembly and having an axially open assembly hole through which the valve subassembly can pass. A cover closes the assembly hole and is formed with an axially throughgoing cover hole through which the dispensing element projects and with which the dispensing element forms an annular and axially extending passage opening axially inward at an axial inner face of the cover. A seal ring surrounds the dispensing element and is engaged between an axially outer face of the holder and the axially inner face of the cover. A spring biases the dispensing element axially outward against the seal ring and presses an axial outer face of the seal ring against the axially inner face of the cover. Formations on a radial outer surface of the holder form passages that extend axially between an interior of the container and the seal ring so that, when gas pressure at the gap exceeds gas pressure inside the container, gas flows axially inward through the gap, between the cover and ring faces, and through the passage to the interior of the container.

In other words, according to the invention, gas channels are formed on the radial outer surface of the valve holder that extend from the axial inner face of the valve plate to the surface of the seal ring and together with a gap that is provided between the dispensing element and the throughgoing passage surrounding the dispensing element and ends on an axial outer face of the seal ring, form a flow path for pressurizing an aerosol container closed by the valve. When pressurizing an aerosol container closed by the valve, high pressure builds up on the axial outer face of the seal ring. The dispensing element can remain in the position in which the port of the dispensing element is closed by the seal ring.

Since the seal ring is supported on the axial inner face by the dispensing element, the seal ring continues to seal the valve holder and prevents the propellant from entering into the valve holder. In contrast, the sealing force between the axial outer face of the seal ring and the adjoining surface decreases as a result of the filling pressure acting on the axial outer face of the seal ring. Due to the filling pressure acting on the axial outer face of the seal ring, the seal ring deforms and a flow path is opened between the axial outer face of the seal ring and the surface sealing the valve holder. The propellant flows off radially over the entire face of the seal ring and is fed directly by the gas channels into the interior of the aerosol container. After the filling procedure ends and the pressure acting from the outside on the axial outer face of the seal ring has been relieved, the seal ring once again lies against the cover surface with a sufficient sealing effect. The sealing effect also results from the internal pressure of the filled aerosol container acting on the circumferential edge of the seal ring and increasing a pre-load of the seal ring. In this way, the flow path that was used for pressure-filling is closed again in a reliable manner.

The described filling procedure pertains particularly to filling with propellants. The product can be supplied in a separate procedural step. To do so, the dispensing element is pressed downward so that the port of the dispensing element connects to the valve holder of the valve subassembly and filling with the product can take place through the dispensing element and its port through the valve holder and an intake tube connected underneath.

Other types of filling are not to be excluded. For example, the valve subassembly according to the invention allows pressure-filling with propellants when the dispensing element is pressed downward until the port of the dispensing valve is connected to the valve holder of the valve subassembly in a flow-technical manner. The flow path of the propellant hereby extends via the gap, seal ring, and gas channels, as well as via the dispensing element, its port through the valve holder, and an intake tube connected underneath.

Falling under the inventive concept are a plurality of structural configurations of the valve that will be explained below. According to a first embodiment, the assembly opening of the valve holder is accessible on the axial outer side of the valve plate and the throughgoing passage for the dispensing element is in a cover disk that is attached to the valve plate and closes the assembly opening of the valve holder. The valve holder of the valve can be fitted from the valve plate outer side with the valve subassembly, i.e. at least one dispensing element, one seal ring, and the compression spring. Thereafter, fixing the cover disk is all that is required to seal the valve holder. The described construction of the invention allows for a simple and fully automated assembly that is distinguished by a low number of assembly steps. The gas channels provided for pressure-filling an aerosol container closed by the valve extend from the axial inner face of the valve plate to a surface of the cover disk.

The valve plate and cover disk consist preferably of plastic, and multiple possibilities come under consideration to connect the valve plate and the cover disk. For example, the cover disk can be welded or bonded in place. Alternatively, the cover disk and the valve plate can be connected in a form-fitting manner by a snap-lock connection. An advantageous structural configuration of such a snap-lock connection provides that the valve plate has on its axial outer end a collar in which the cover disk can be inserted to lie flush and that the cover disk is fixed to the inner wall surface of the collar by snap-on elements. This structural configuration allows for a very simple assembly in that a connection is made that cannot be released in a non-destructive manner. According to a variant of the embodiment, the cover disk is formed with a collar on the axial outer end of the valve plate and is fixed to the radial outer side of the collar by snap-on elements. The arrangement consisting of a collar and a cover disk is distinguished, regardless of the actual structural configuration, by a high degree of dimensional stability that has an advantageous effect on the function of the valve.

Appropriately, the valve plate and the valve holder are made of plastic and can be produced cost-effectively as a one-piece injection molded part that combines both functions. The plastic injection molded part has the shape of a valve plate and a formed-on valve holder for the valve subassembly. The valve holder is an integral component of the valve plate and is connected to it in a one-piece manner. This design has a recess, with a seat face for the seal ring, formed into the axial outer face of the valve plate. The gas channels are arranged on the surface of the recess and extend to the axial inner end of the valve plate.

While the valve plate has standardized dimensions for many applications, the length and the diameter of the valve holder depend on the structural configuration of the valve subassembly and the design of its valve elements. For that reason, it may be advantageous if the valve holder and the valve plate are separate components that can be combined with each other. An advantageous embodiment of the invention provides that the valve holder and the valve plate are separate components, the valve plate has an assembly hole to install the valve holder, and the component forming the valve holder can be inserted into the assembly hole from the axial outer side of the valve plate. In this embodiment, all assembly steps, namely inserting the valve holder into the valve plate, fitting the valve holder with valve elements, and sealing the valve holder with the cover disk can be done on one side, namely the axial outer side of the valve plate. This simplifies assembling the valve to a substantial degree.

Appropriately, the separate component forming the valve holder has on its axial outer face an annular seat face for the seal ring as well as external longitudinal ribs that extend past the seat face and surround the seal ring resting on the seat face. In doing so, the longitudinal ribs may have a collar that rests on a shoulder face within the assembly hole of the valve plate. The shoulder face within the assembly hole of the valve plate also is formed by an array of ribs whose rib widths and the rib spacings are conformed to the longitudinal ribs on the radial outer side of the component forming the valve holder. The valve plate and the component forming the valve holder may be produced cost-effectively as injection molded plastic parts.

In the above-described embodiments of the invention, the valve holder for the valve subassembly is always closed by a cover disk that has a cover hole for the dispensing element and is attached to the axial outer side of the valve plate. A second design variant, which is also to be included in the inventive concept, provides that the valve holder and the valve plate are separate components, the throughgoing passage for the dispensing element is in the valve plate, and the axial inner side of the valve plate is formed with an extension for attaching the component forming the valve holder. In this structural configuration, a cover disk is not required. The valve holder must initially be fitted with the valve subassembly and can then be attached as a prefabricated assembly on the axial inner side of the valve plate. Provided for attachment purposes, the extension on the axial inner side of the valve plate is preferably designed as a sleeve into which the component forming the valve holder can be inserted. Preferably, the valve holder has on its axial outer side an annular seat face for the seal ring as well as external longitudinal ribs that project at the seat face and surround the seal ring resting on the seat face. The extension and the valve holder may be connected to each other by a weld joint, an adhesive bond, a form-fit plug-in connection, a screw connection, or a snap-lock connection.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
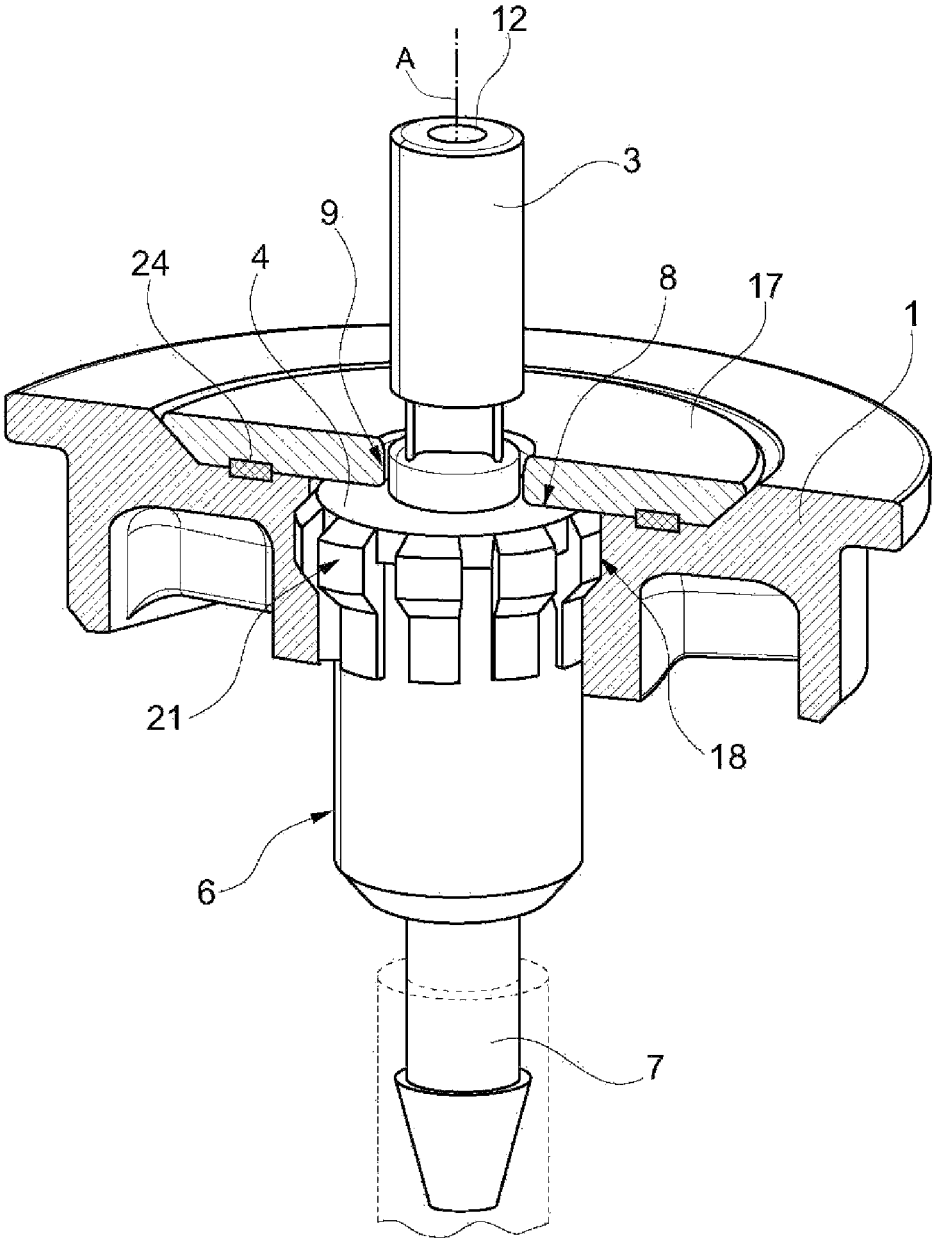
FIG. 1 is a partly sectional view of a valve for an aerosol container.

As seen in the drawing, the valve shown in multiple embodiments basically comprises a valve plate 1, a valve subassembly 2 that comprises at least one star-shaped dispensing element 3, a seal ring 4 and a compression spring 5, as well as a holder 6 for the valve subassembly. All these parts are centered on an axis A (FIG. 1). The holder 6 has on its axial inner (downward in the drawing) end a connection 7 for an intake tube as well as an assembly opening on its axial outer side for inserting the valve subassembly 2. The assembly opening of the holder 6 mounted on the valve plate is closed by a cover face 8 that has a throughgoing cover hole 9 for the dispensing element 3. The seal ring 4 is clamped between this cover face 8 and an annular seat face 19 surrounding the assembly opening of the holder 6 and closes a port 11 of the dispensing element 3 when the dispensing element 3 is pressed axially against the seal ring 4 under the effect of compression spring 5. The port 11 forms a dosage opening.

Figure 3A:
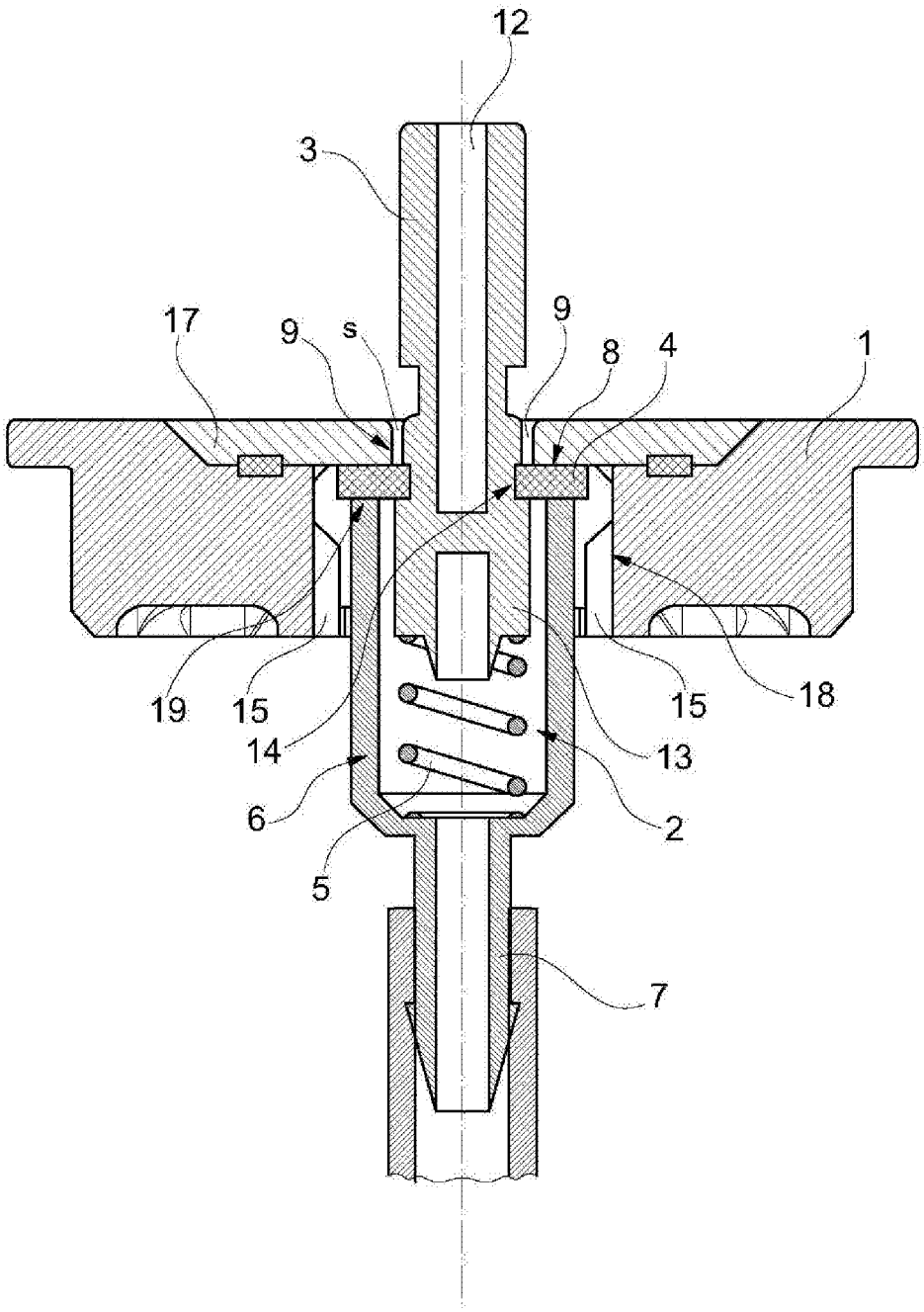
FIGS. 3A and 3B are cross sections through the valve of FIG. 1 in two different planes.
Figure 3B:
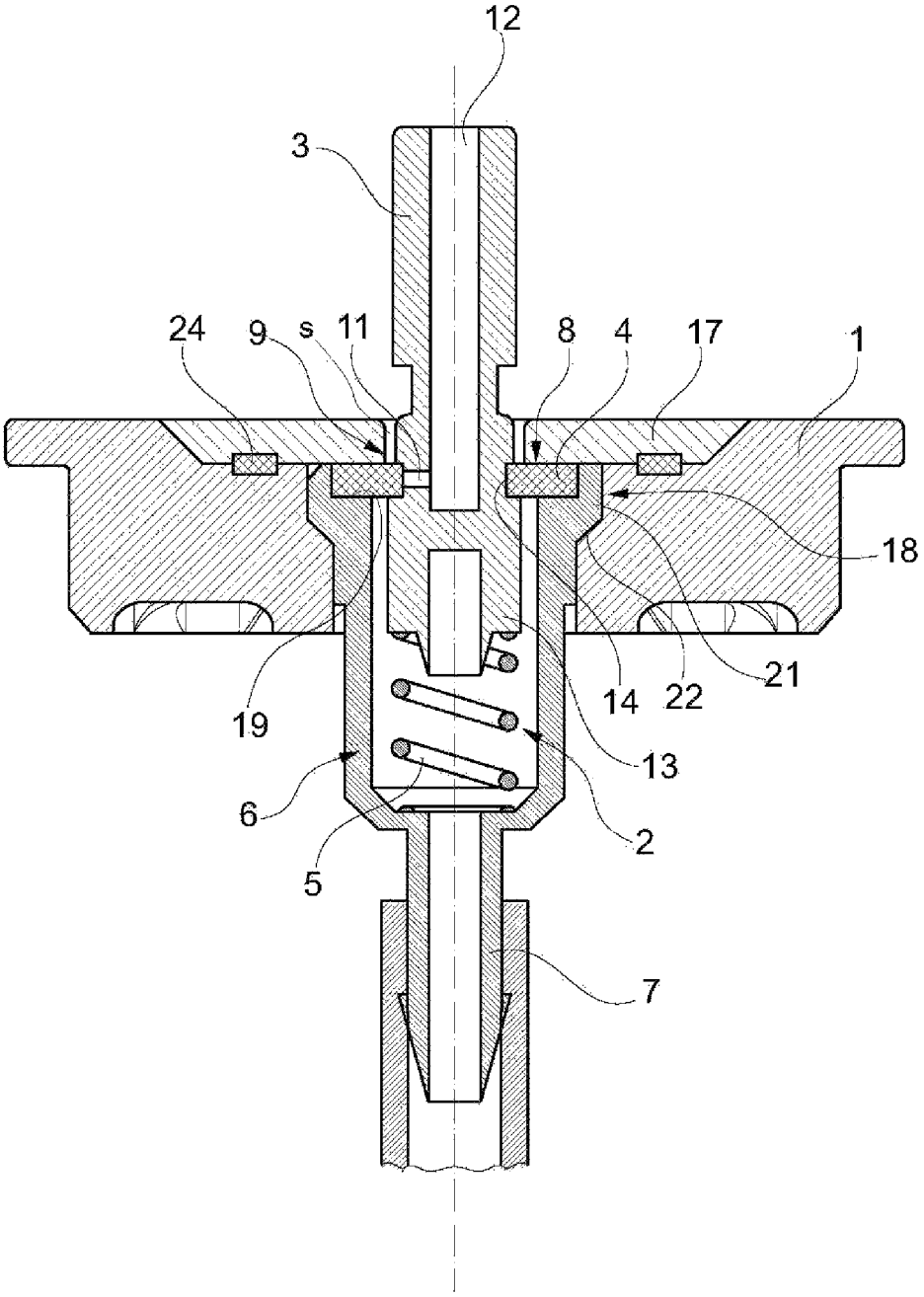

The dispensing element 3 is tubular according to FIGS. 3A and 3B and has a blind hole 12 open laterally at at least one port 11. Here, the port 11 extends radially through the wall of the dispensing element. The dispensing element 3 has a guide section 13 braced against the spring 5 of the valve subassembly 2, and is axially moveable inside the holder 6. The port 11 is above the guide section 13 and opens into to an annular groove 14. In the position of FIGS. 3A and 3B, the seal ring 4 engages in the groove 14 and closes the port 11. For dispensing a product out of the pressurized aerosol container, the dispensing element 3 is pressed down so that the port 11 is exposed and the pressurized content flows out through the port 11 and the hole 12.

The seal ring 4 is appropriately constructed as an annular disk and is made of a polymer suited for sealing purposes. Preferred are sealing materials, particularly natural rubber, synthetic rubber, or thermoplastic elastomers.

Figure 4:
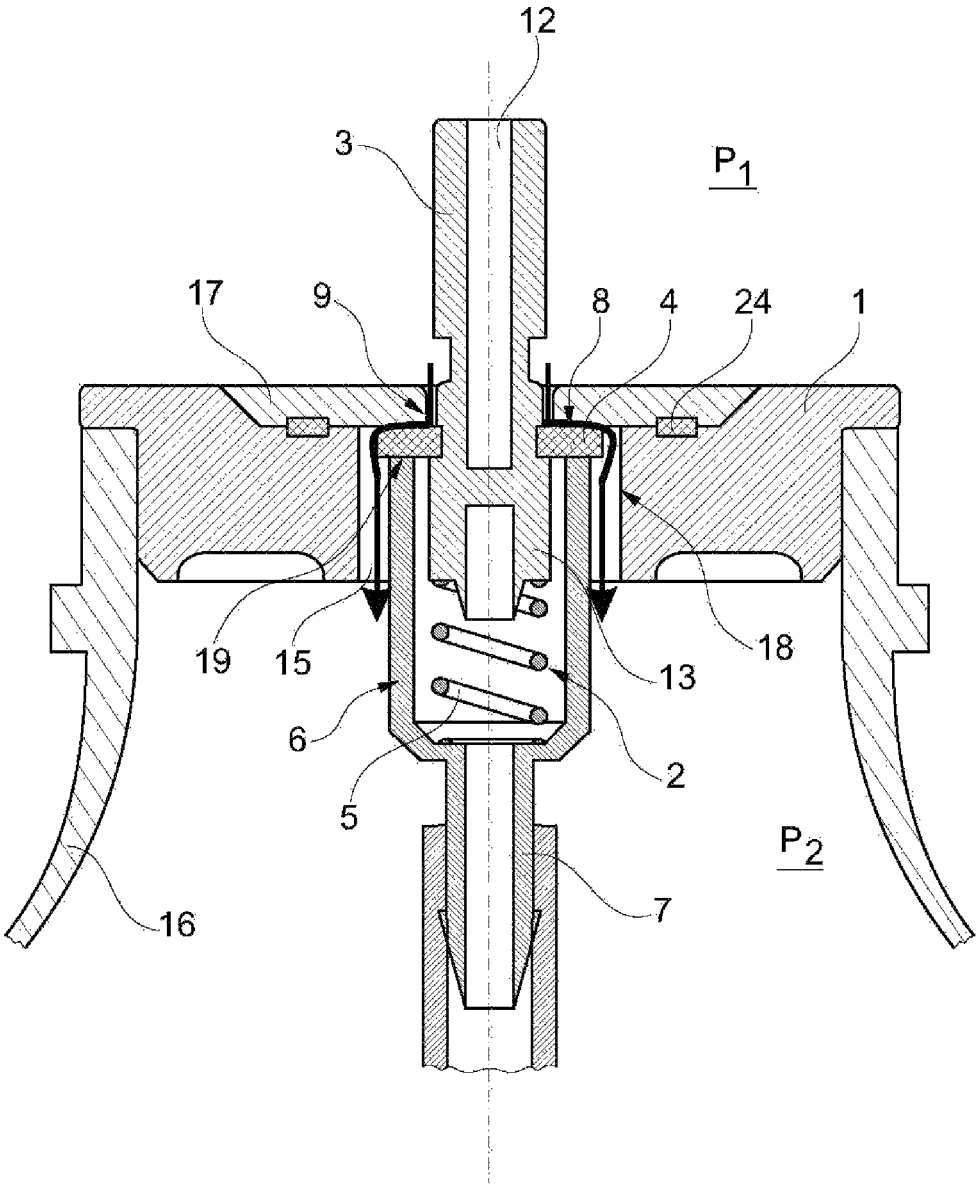
FIG. 4 shows the flow path through the valve of FIG. 1 during pressure-filling of an aerosol container closed by the valve.

A comparison of FIGS. 1 to 3A and 3B shows that the radial outer surface of the holder 6 is formed with gas channels 15 that extend from the axial inner face of the valve plate 1 to the surface of the seal ring 4. Together with a gap between the dispensing element 3 and the cover hole 9 surrounding the dispensing element, these gas channels 15 form a flow path for pressure-filling an aerosol container 16 closed by the valve. The flow path is shown in FIG. 4. During pressure-filling, the dispensing element remains in the position of FIG. 4. Between the dispensing element 3 and the cover hole 9 surrounding the dispensing element, there is a gap s that ends at an axial outer face of the seal ring 4. During pressure-filling aerosol container 16, pressure $p_1$ outside the valve is greater than pressure $p_2$ inside the as yet unfilled aerosol container 16. Pressure $p_1$ builds up at the axial outer face of the seal ring 4. The seal ring 4 is engaged on the axial inner face by the dispensing element 3 under the force of the spring 5 and closes the holder 6. Under the effect of pressure $p_1$ acting on the axial outer face of the seal ring 4, an elastic deformation of the seal ring 4 occurs that forms a flow path between the axial outer face of the seal ring 4 and the axial inner cover face 8 sealing the holder 6. The propellant flows radially outward along the flow path indicated by arrows over the entire face of the seal ring 4 and is guided by the adjacent gas channels 15 into the interior of the aerosol container 16. When the filling process is complete and the pressure acting from the outside on the axial outer face of the seal ring 4 is relieved, the seal ring 4 rests once again with a sufficient sealing effect on the cover face 8. In this way, the flow path that was used for pressure-filling is reliably sealed off again.

Figure 2:
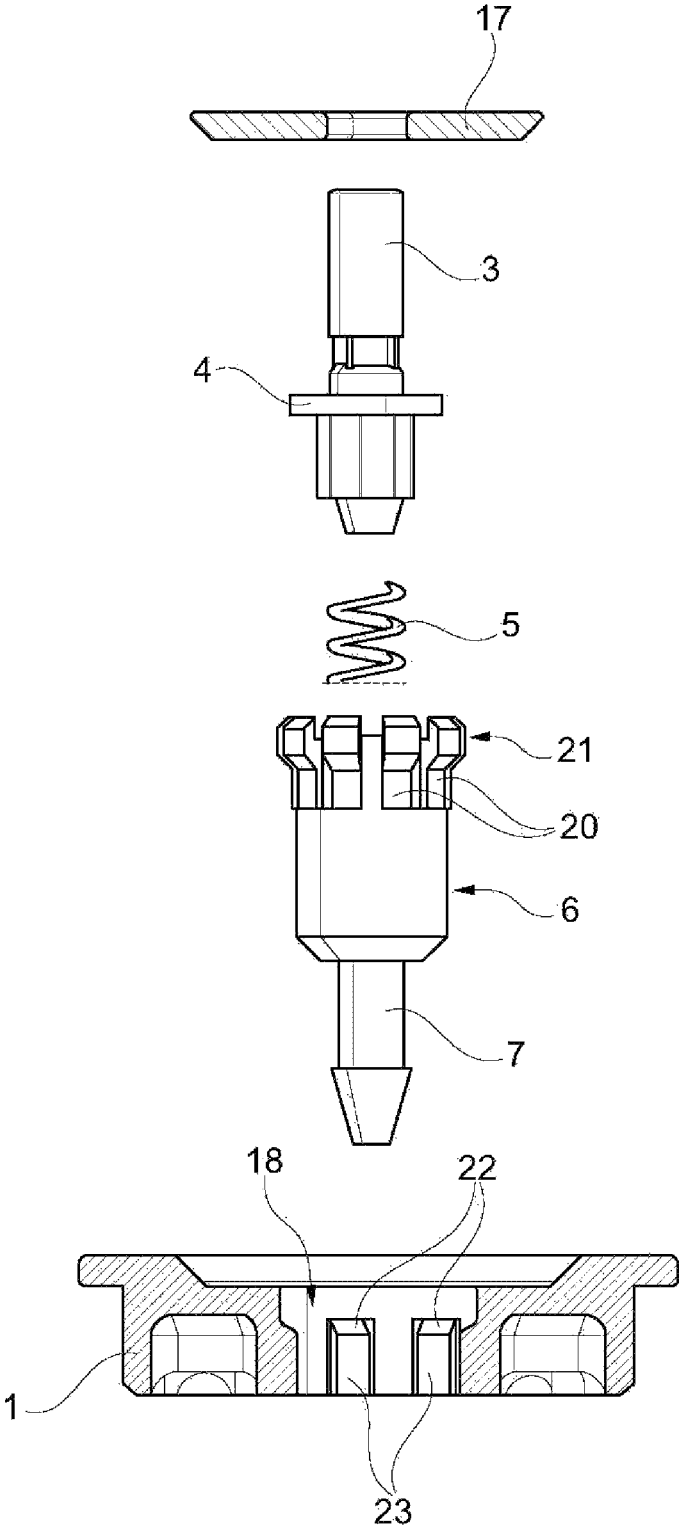
FIG. 2 is an exploded view of the valve of FIG. 1.

In the embodiment of FIGS. 1 to 3, the assembly opening of the holder 6 is accessible from the axial outer side of the valve plate 1 and the cover hole 9 for the dispensing element 3 is in a cover disk 17 that is attached to the valve plate 1 and closes the assembly opening of the holder 6. The channels 15 extend all the way to the axial inner face of the cover disk 17.

In the embodiment of FIGS. 1 to 3, the holder 6 and the valve plate 1 are separate components made preferably of plastic and can be produced as inexpensive injection-molded parts. The valve plate 1 has a hole 18 for mounting the holder 6. One can see from the exploded view in FIG. 2 that the component forming the holder 6 on the axial outer end of the valve plate 1 can be inserted into the hole 18. From FIGS. 1 and 2, one can also see that the holder 6 has on its axial outer face the seat face 19 for the seal ring 4 as well as external longitudinal ribs 20. These ribs 20 extend past the seat face 19 and surround the seal ring 4 resting on the seat face 19. To support the component forming the holder 6, the longitudinal ribs 20 are constructed with a collar 21 that rests on a shoulder face 22 inside the hole 18 of the valve plate 1. FIG. 2 shows that a shoulder face 22 is formed by a plurality of ribs 23 formed in the hole of the valve plate 1. The ribs 23 inside the hole 18 of the holder 6 and the external longitudinal ribs 20 of the holder 6 are of complementary shape. The number of ribs and the spacing between the ribs determine the throughput rate of the filling process.

The valve plate 1 and the cover disk 17 are made of plastic and are bonded together in the embodiment of FIG. 1 at a weld 24. The weld 24 can be produced by a laser technique in particular. Other weld methods with ultrasound, infrared, and similar are also possible.

Figure 9:
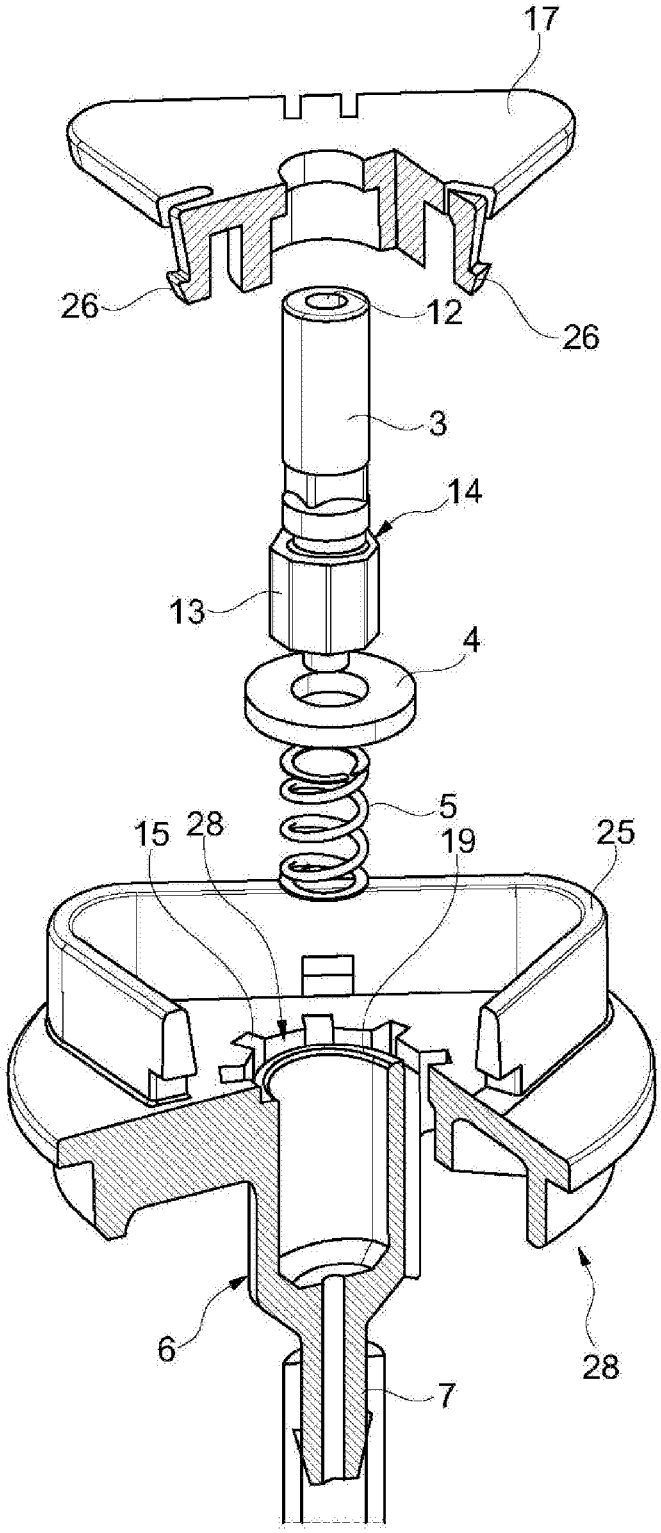
FIGS. 9 and 10 show variants of the valve.
Figure 10:
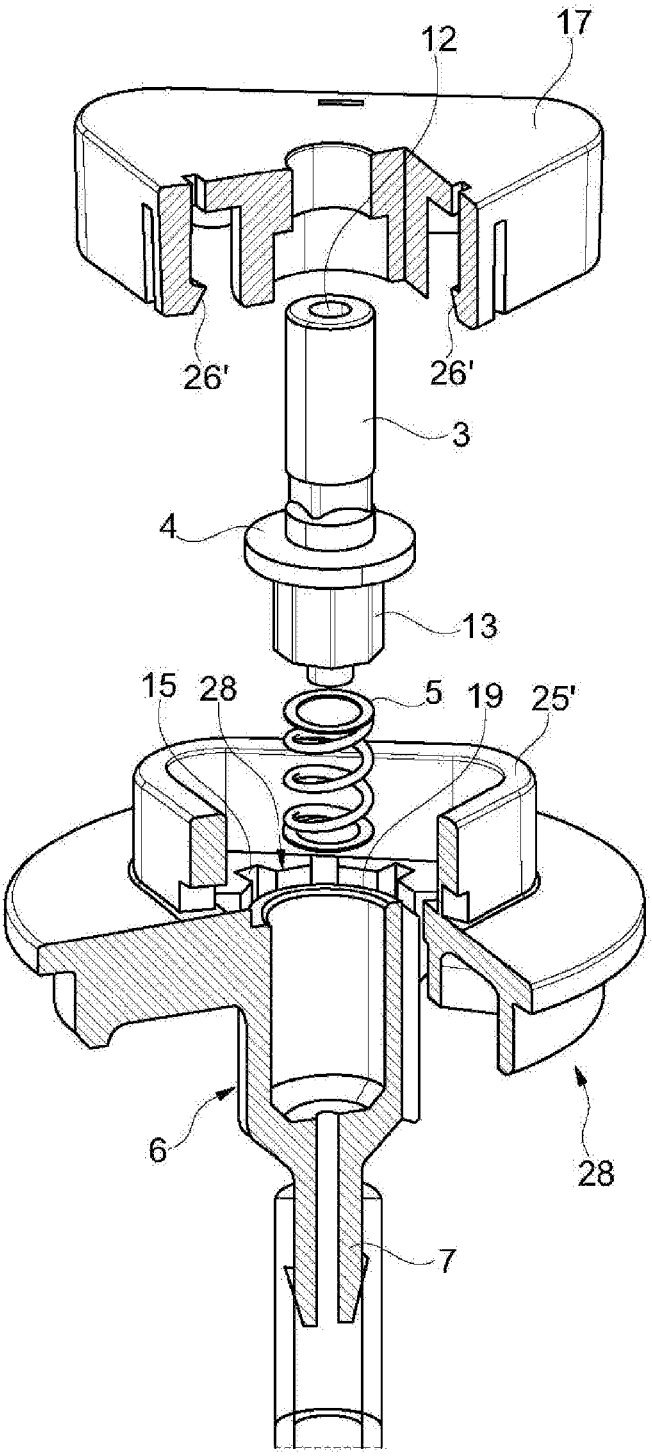

The cover disk 17 and the valve plate 1 can also be connected alternatively by a snap-lock connection. Possible designs of such a snap-lock connection are shown in FIGS. 9 and 10. In the embodiment of FIG. 9, the valve plate 1 has on its axial outer face a collar 25 in which the cover disk 17 is inserted to sit flush and is secured by latch elements 26 to the inner face of the collar 25. The snap-lock connection is designed in such a manner that it cannot be disconnected without destroying the structure. According to the embodiment of FIG. 10, the cover disk 17 has an external collar 25' secured by latch elements 26' to the radial outer side of a collar 25' on the axial outer side of the valve plate 1.

Figure 5:
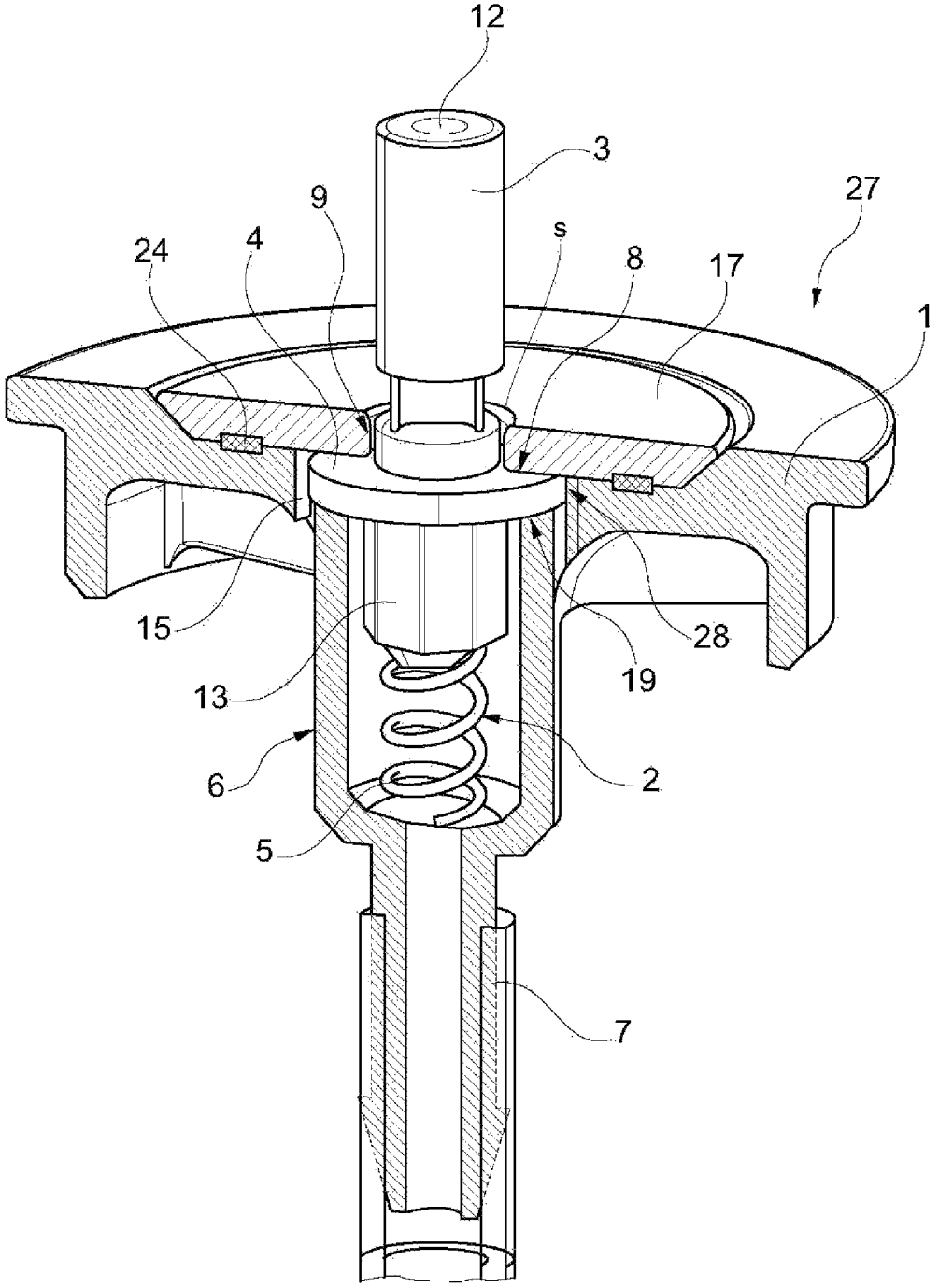
FIG. 5 is a perspective and partly sectional view of another embodiment of the valve.
Figure 6:
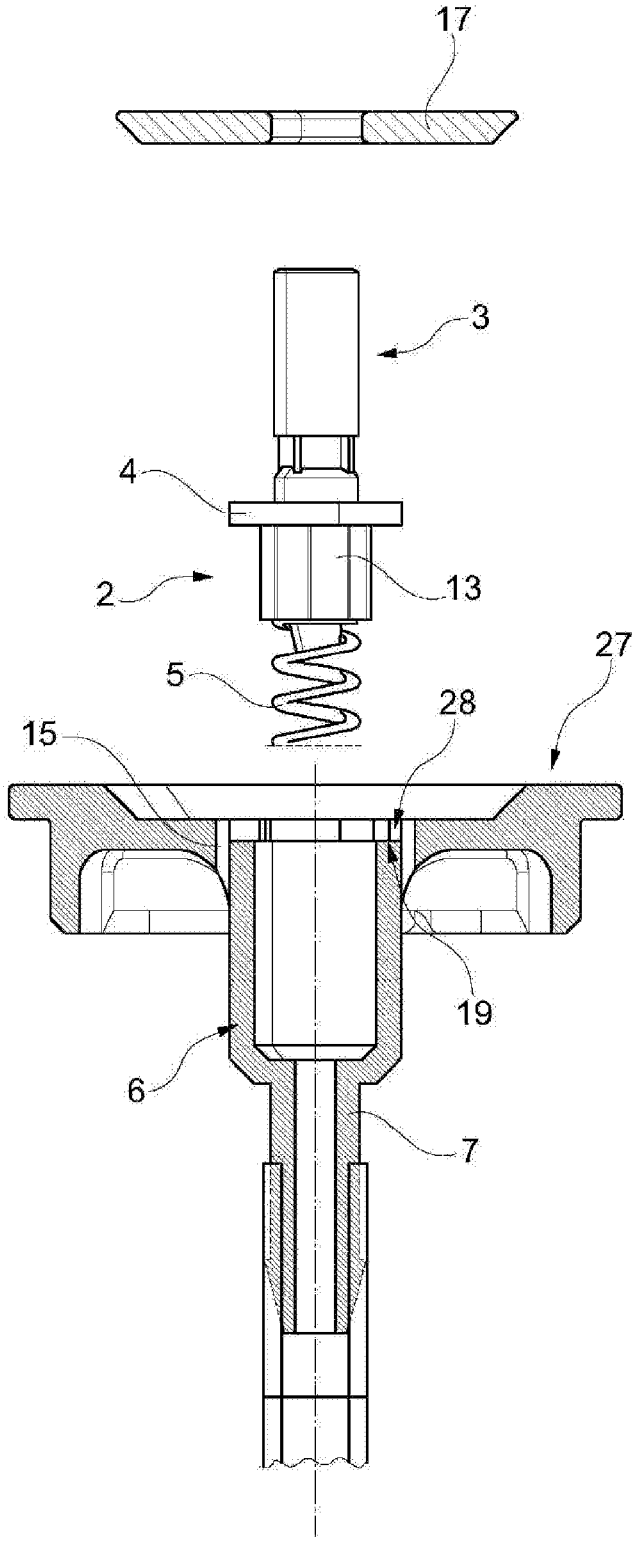
FIG. 6 is an exploded view of the valve of FIG. 5.
Figure 7:
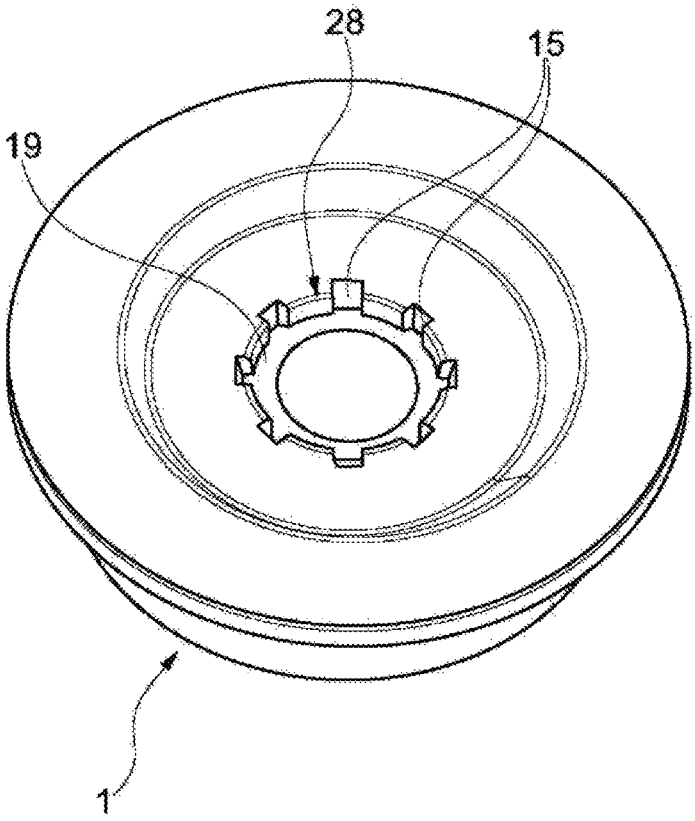
FIG. 7 is a top view of a valve plate of the valve of FIG. 5.
Figure 8:
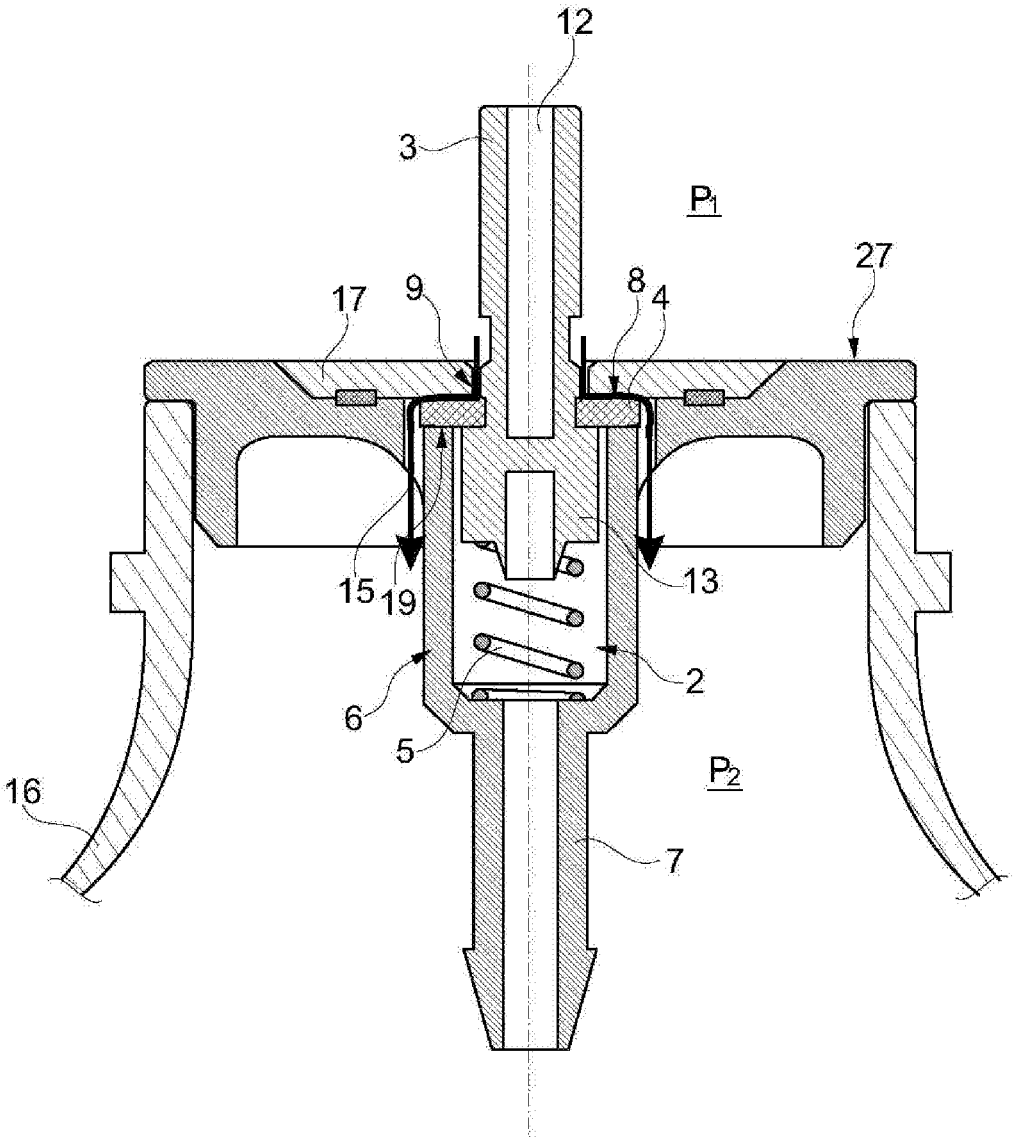
FIG. 8 shows the flow path through the valve of FIG. 5 during pressure-filling an aerosol container closed by the valve.

According to an embodiment of the invention shown in FIGS. 5 to 7, the valve plate 1 and the holder 6 are constructed as a one-piece, plastic injection-molded part 27. The holder 6 is unitary with the valve plate 1. The axial outer face of the valve plate 1 is formed with a recess 28 with the seat face 19 for the seal ring 4. According to FIGS. 5 to 7, the channels 15 are formed on the surface of the recess 28 and extend to the axial inner face of the valve plate 1. The channels 15 form, together with the gap s between the dispensing element 3 and throughgoing passage 9 surrounding the dispensing element, a flow path for pressure-filling an aerosol container 16 closed by the valve. The flow path for pressure-filling is shown in FIG. 8.

In the above-described embodiments, the assembly opening of the holder 6 is accessible on the axial outer side of the valve plate 1 so that the complete assembling of the valve can be executed on the axial outer side of the valve plate 1.

Figure 11A:
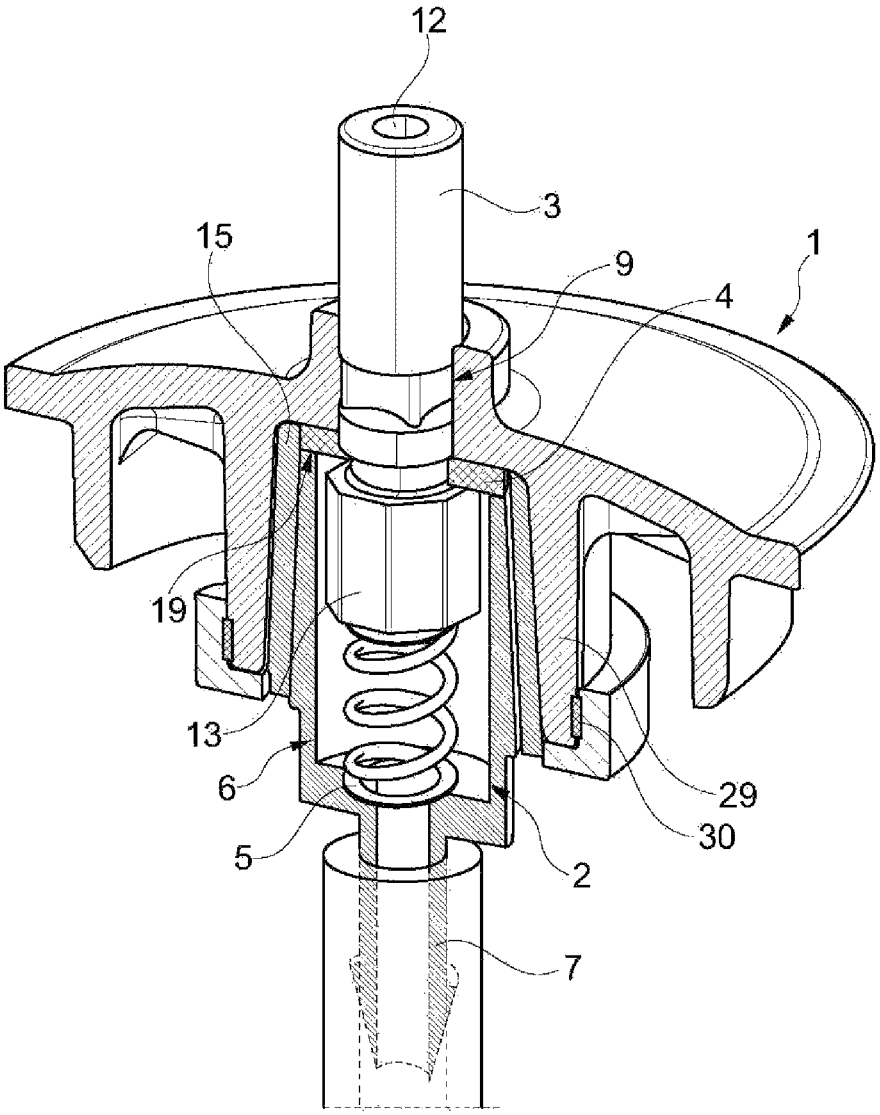
FIGS. 11A to 11C are views of another embodiment of the valve of the invention.
Figure 11B:
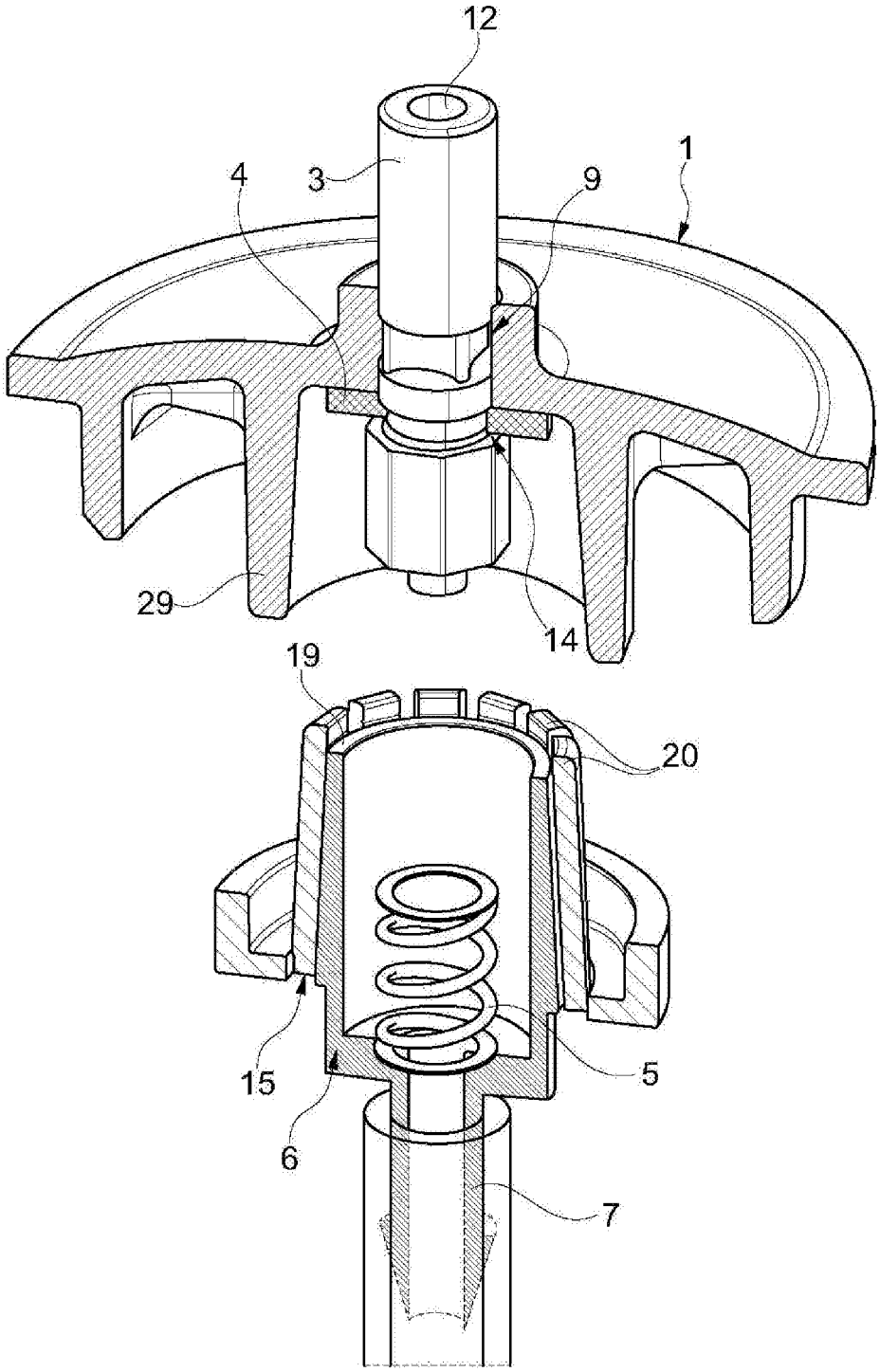
Figure 11C:
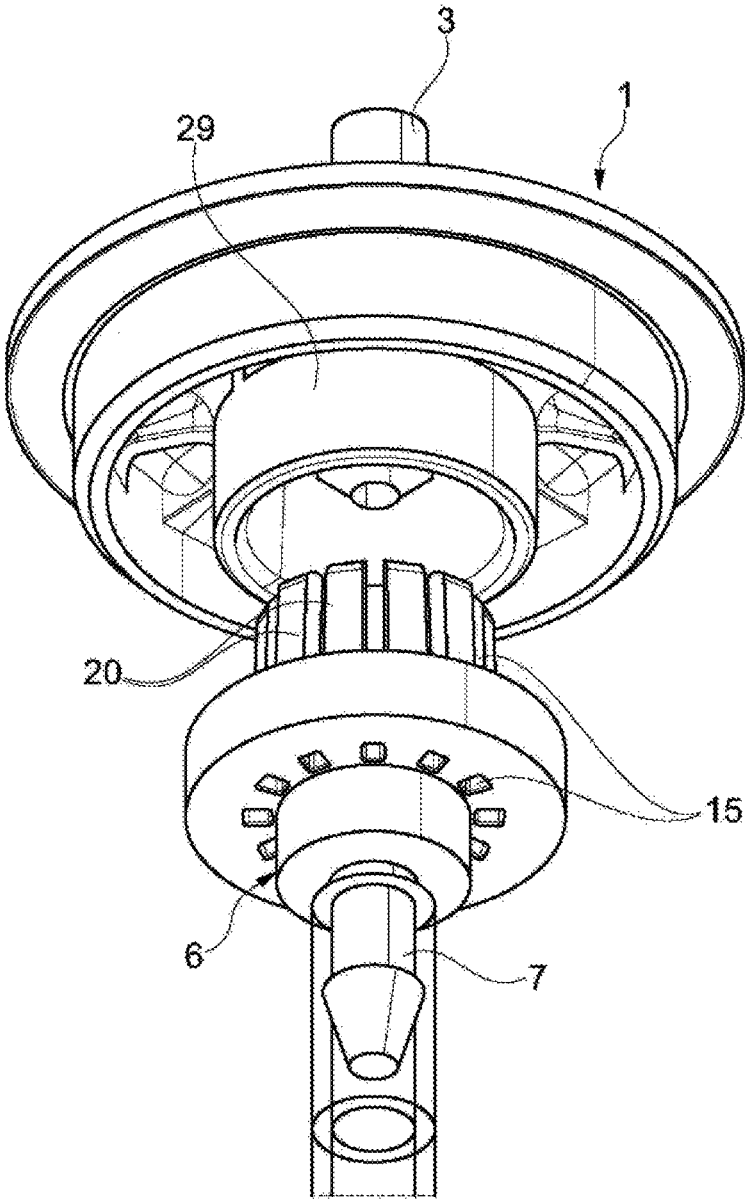

FIGS. 11A to 11C show another design of the valve of the invention, in which the holder 6 and the valve plate 1 are separate components and the holder 6 is mounted on the axial inner side of the valve plate 1. The axial inner side thereby refers to that side of the valve plate 1 that is exposed inward to the pressurized space of an aerosol container. In the embodiment of FIGS. 11A to 11C, the cover hole 9 for the dispensing element 3 is formed in the valve plate 1 and an extension 29 is formed on to the axial inner face of the valve plate 1 for attaching the part forming the holder 6. The holder 6 has on its axial outer face the annular seat face 19 for the seal ring 4 as well as the external longitudinal ribs 20 that extend past the seat face 19 and surround the seal ring 4 resting on the seat face 19. Here, the extension 29 and the holder 6 are bonded together by a weld 30. Preferably, laser welding is used. Instead of a weld, the extension 29 and the holder 6 can also be connected by an adhesive bond, by a form-fitting plug-in connection, a screw connection, or a snap-lock connection.

We claim:

1. A valve for an aerosol container comprising:

a valve plate adapted to close an axial end of the container;

a valve subassembly having at least one dispensing element, a seal ring, and a compression spring;

a valve holder containing the valve subassembly and having an axially open assembly hole through which the valve subassembly can pass;

a cover closing the assembly hole and formed with an axially throughgoing cover hole through which the dispensing element projects and with which the dispensing element forms an annular and axially extending passage opening axially inward at an axial inner face of the cover and outward at a gap between the dispensing element and the cover;

a seal ring surrounding the dispensing element and engaged between an axially outer face of the holder and the axially inner face of the cover;

a spring biasing the dispensing element axially outward against the seal ring and pressing an axial outer face of the seal ring against the axially inner face of the cover; and channels on the holder extending axially between an interior of the container and the seal ring, whereby, when gas pressure at the gap exceeds gas pressure inside the container, gas flows axially inward through the gap and through the passage and channels to the interior of the container.

2. The aerosol-container valve defined in claim 1, wherein the assembly opening of the valve holder opens on an axial outer face of the valve plate and the cover is a disk that is formed with the throughgoing cover hole for the dispensing element, that is attached to the valve plate, and that closes the assembly opening of the valve holder.

3. The aerosol-container valve defined in claim 2, wherein the gas channels extend to the inner face of the cover disk.

4. The aerosol-container valve defined in claim 2, wherein the valve plate and the cover disk are made of plastic and are connected integrally to each other.

5. The aerosol-container valve defined in claim 2, wherein the valve plate and the cover disk are made of plastic and are connected in a form-fit by a snap-lock connection.

6. The aerosol-container valve defined in claim 5, wherein the valve plate has on its axial outer face a collar in which the cover disk is set flush, the cover disk being secured by latch elements to the radially inner side of the collar.

7. The aerosol-container valve defined in claim 6, wherein the cover disk surrounds the collar formed on the axial outer face of the valve plate and the latch elements are secured to a radial outer side of the collar.

8. The aerosol-container valve defined in claim 2, wherein the valve plate is formed with a recessed seat holding the seal ring on an axial outer face of the valve plate, the gas channels extending between the seat and an axial inner face of the valve plate.

9. The aerosol-container valve defined in claim 1, wherein the valve plate has a hole for mounting the valve holder, the valve holder being inserted into the hole on the axial outer face of the valve plate.

10. The aerosol-container valve defined in claim 1, wherein the valve holder has external longitudinal ribs that extend past the outer face of the holder and surround the seal ring resting on the seat face.

11. The aerosol-container valve defined in claim 10, wherein the longitudinal ribs form a collar that rests on a shoulder face inside the hole of the valve plate.

12. The aerosol-container valve defined in claim 11, wherein the shoulder face is formed by the plurality of ribs.

13. The aerosol-container valve defined in claim 1, wherein the valve plate and the valve holder are separately produced plastic injection-molded parts.

14. The aerosol-container valve defined in claim 1, wherein the valve holder and the valve plate are separate components, the throughgoing cover hole for the dispensing element being in the valve plate, the axial inner face of the valve plate being formed with an extension for attaching the component forming the valve holder.

15. The aerosol-container valve defined in claim 14, wherein the extension is constructed as a sleeve into which the component forming the valve holder can be inserted.

16. The aerosol-container valve defined in claim 15, wherein the component forming the valve holder has on its axial outer face an annular seat face for the seal ring and external longitudinal ribs that extend past the seat face and surround the seal ring resting on the seat face.

17. The aerosol-container valve defined in claim 14, wherein the extension and the valve holder are joined by a weld, an adhesive bond, a form-fitting plug-in connection, a screw connection or a snap-lock connection.

18. A valve for an aerosol container comprising:

a valve plate adapted to close an axial outer end of the container;

a valve subassembly having at least one dispensing element, a seal ring, and a compression spring;

a valve holder extending axially inward from the valve plate, containing the valve subassembly, and having an axially outwardly open assembly hole through which the valve subassembly can pass;

a cover disk axially outwardly closing the assembly hole, fixed to the valve plate, and formed with an axially throughgoing cover hole through which the dispensing element projects and with which the dispensing element forms an annular, outwardly open, and axially extending passage opening axially inward at an axial inner face of the cover disk and outward at an annular gap between the dispensing element and the cover disk;

a seal ring surrounding the dispensing element and engaged between an axially outer face of the holder and the axially inner face of the cover disk;

a spring biasing the dispensing element axially outward against the seal ring and pressing an axial outer face of the seal ring against the axially inner face of the cover disk; and formations on the holder forming passages extending axially between an interior of the container and past the seal ring to the inner face of the cover disk, whereby, when gas pressure at the gap passage exceeds gas pressure inside the container, gas flows axially inward through the passage, between the cover disk and ring faces, and through the passage and channels to the interior of the container.

* * * * *